US008608513B2

(12) United States Patent
Lee

(10) Patent No.: US 8,608,513 B2
(45) Date of Patent: Dec. 17, 2013

(54) LAMP AND ASSEMBLY STRUCTURE THEREOF

(76) Inventor: Shih Hung Lee, Hsinchu (TW)

( * ) Notice: Subject to any disclaimer, the term of this patent is extended or adjusted under 35 U.S.C. 154(b) by 110 days.

(21) Appl. No.: 13/334,772

(22) Filed: Dec. 22, 2011

(65) Prior Publication Data

US 2012/0184121 A1 Jul. 19, 2012

(30) Foreign Application Priority Data

Jan. 19, 2011 (TW) ..... 100201187 U

(51) Int. Cl.
*H01R 24/04* (2006.01)

(52) U.S. Cl.
USPC ..... 439/668; 439/928

(58) Field of Classification Search
USPC ..... 439/668, 669, 928; 362/236, 368
See application file for complete search history.

(56) References Cited

U.S. PATENT DOCUMENTS 5,496,657 A * 3/1996 Dixon, Jr. ..... 429/62
6,805,605 B2 * 10/2004 Reining et al. ..... 446/91
7,080,927 B2 * 7/2006 Feuerborn et al. ..... 362/368
7,404,743 B2 * 7/2008 Chen et al. ..... 439/669
7,407,416 B1 * 8/2008 Rogers et al. ..... 439/669
7,553,162 B2 * 6/2009 Isoda et al. ..... 439/56
7,614,918 B1 * 11/2009 Wu ..... 439/669
7,731,558 B2 * 6/2010 Capriola ..... 446/91
7,956,967 B2 * 6/2011 Teramoto ..... 349/122
8,182,293 B2 * 5/2012 Tang et al. ..... 439/668

* cited by examiner

*Primary Examiner* — Thanh Tam Le
(74) *Attorney, Agent, or Firm* — Chun-Ming Shih

(57) ABSTRACT

The embodiments disclose a lamp assembly structure that allows a plurality of lamp assemblies to form lamps of different configurations. The lamp assembly structure includes a plurality of independent block bodies, each block body has at least one convex connector or/and at least one concave connector. At least one block body has a luminous body. At least a part of the convex connector or/and the concave connector has an electrical connection component. The electrical connection component and the luminous body are connected electrically. When one block body and its adjacent block body are assembled together, the convex connector of one of the two block bodies is plugged into the concave connector of the other of the two block bodies so as to tightly combine the two block bodies. As a result the electrical connection components of the two block bodies are connected physically and electrically.

13 Claims, 9 Drawing Sheets

LAMP AND ASSEMBLY STRUCTURE THEREOF

BACKGROUND

1. Technical Field

The invention relates generally to a lamp, and more particularly, to a structure that allows multiple lamp components to be assembled together.

2. Related Art

Many lamps mainly serve the illumination purposes. Some lamps can additionally serve decorative purposes. But the shape of a lamp cannot have significant changes once it has been manufactured. As time pass by, the lamp with fixed shape will become boring. As a result, it's desirable to have a lamp that can change its configuration anytime.

BRIEF SUMMARY

The invention provides a lamp that can be assembled by a plurality of independent block bodies.

The invention provides a lamp that is easy to assemble. Its owner can change the assembly and configuration of the lamp freely.

Accordingly, A lamp of the invention comprises a plurality of independent block bodies, each comprising at least one convex connector or/and at least one concave connector, wherein at least one block body has a luminous body, at least a part of the convex connector or/and the concave connector has an electrical connection component, the electrical connection component and the luminous body are connected electrically, when one block body and an adjacent block body are assembled together, the convex connector of one of the two block bodies is plugged into the concave connector of the other of the two block bodies so as to combine the two block bodies tightly, as a result the electrical connection components of the two block bodies are connected physically and electrically.

The convex and concave connectors are a set of male plug and female socket. The convex connector comprises an electrical connection component formed by an inner conduction column and an outer conduction ring, an insulation ring between the inner conduction column and the outer conduction ring, and a positive terminal and a negative terminal that are connected to the inner conduction column and the outer conduction ring, respectively, the inner conduction column extends out from the outer conduction ring; the concave connector comprises an electrical connection component formed by an outer-layer conduction ring and an inner-layer conduction ring, an insulation ring between the outer-layer conduction ring and the inner-layer conduction ring, and a positive terminal and a negative terminal that are connected to the inner-layer conduction ring and the outer-layer conduction ring, respectively, the outer-layer conduction ring extends out from the inner-layer conduction ring.

The block body has a geometrical configuration, and the block body is selected from a group consisting of cube, triangular prism, cylinder, sphere, semi-cylinder, hemisphere, polygonal pyramid, and polygonal column. At least a part of the block body is transparent or translucent. Some other block bodies 10 can be opaque The lamp of the invention further comprises a power device for providing power to the lamp. The power device is installed within at least one block body, the power device comprises a battery holder and a battery, the block body has an electrical connection component on its convex connector or/and concave connector and the electrical connection component is electrically connected to the battery holder. The power device is a power supply, the power supply provides external electricity, and the power supply can be plugged into any block body that has an electrical connection component.

The luminous body is a light-emitting diode (LED), and the plurality of independent block bodies comprise block bodies with electrical connection components and/or block bodies without electrical connection components.

In another aspect, accordingly, an assembly structure of a lamp for the invention comprises a block body, wherein the block body comprises at least one convex connector or/and at least one concave connector, and each of the convex connector and the concave connector comprises an electrical connection component.

The block body comprises a luminous body, and the luminous body and the electrical connection component are connected electrically. The convex connector and the concave connector correspond to each other, and when two block bodies are assembled together, the convex connector and the concave connector of the two block bodies combine with each other tightly, as a result the electrical connection components of the convex connector and the concave connector are connected physically and electrically.

The convex connector comprises an electrical connection component formed by an inner conduction column and an outer conduction ring, an insulation ring between the inner conduction column and the outer conduction ring, and a positive terminal and a negative terminal that are connected to the inner conduction column and the outer conduction ring, respectively, the inner conduction column extends out from the outer conduction ring; the concave connector comprises an electrical connection component formed by an outer-layer conduction ring and an inner-layer conduction ring, an insulation ring between the outer-layer conduction ring and the inner-layer conduction ring, and a positive terminal and a negative terminal that are connected to the inner-layer conduction ring and the outer-layer conduction ring, respectively, the outer-layer conduction ring extends out from the inner-layer conduction ring.

Compared with related art, the invention provides a lamp that can be assembled and configured freely. It has more variations in shape and is more interesting. The lamp can train its owner's creativity, and hence is very good for education. The lamp can serve as a puzzle or a game, and hence is very good for entertainment. Furthermore, the lamp can also become a decoration with high artistic value.

Other features of the present invention will be apparent from the accompanying drawings and from the detailed description which follows.

BRIEF DESCRIPTION OF THE DRAWINGS

The invention is fully illustrated by the subsequent detailed description and the accompanying drawings, in which like references indicate similar elements.

DETAILED DESCRIPTION

Figure 1:
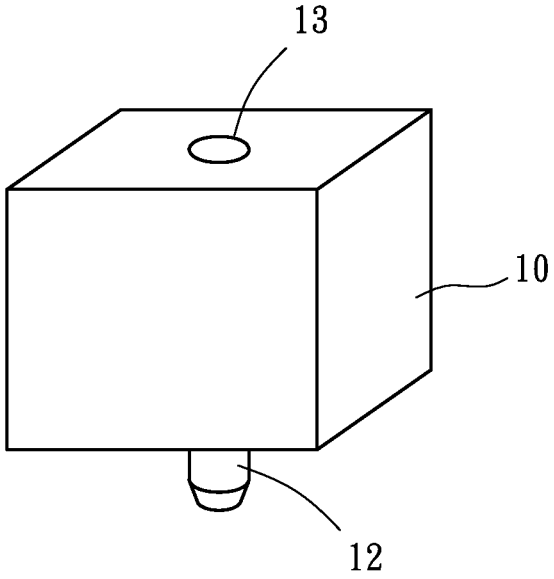
FIG. 1 shows a pictorial view of a block body of a lamp according to an embodiment of the invention.
Figure 2:
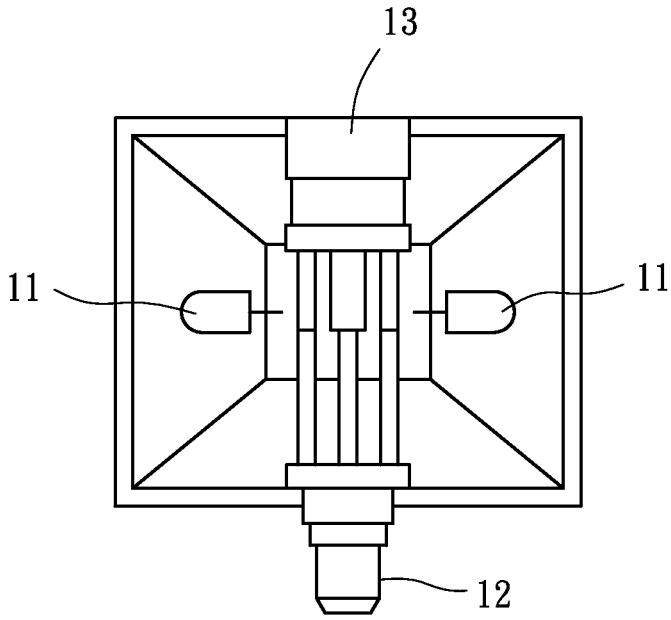
FIG. 2 shows a longitudinal sectional view of FIG. 1.
Figure 3:
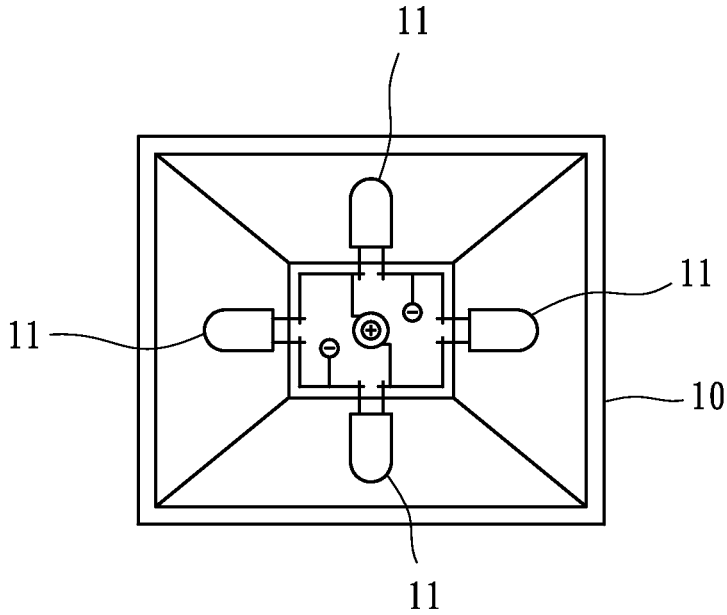
FIG. 3 shows a transversal sectional view of FIG. 1.
Figure 4:
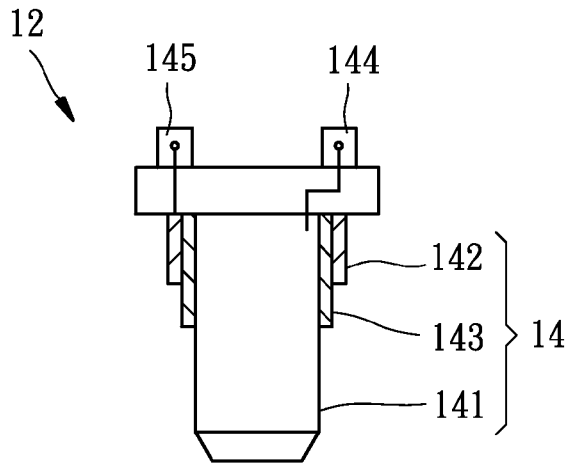
FIG. 4 shows a sectional view of a convex connector according to an embodiment of the invention.
Figure 5:
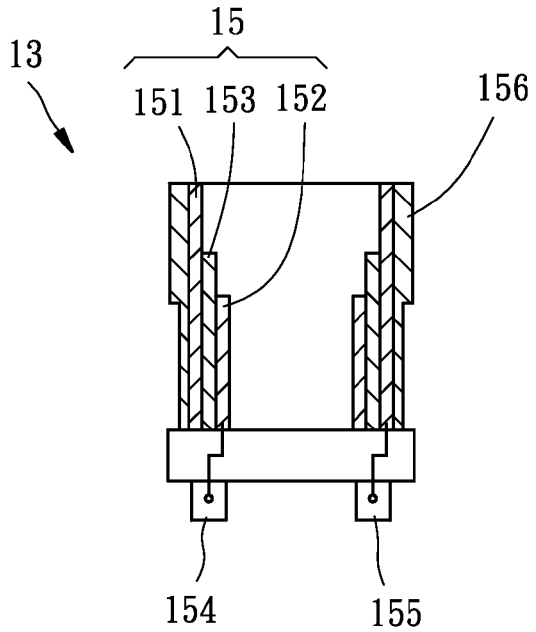
FIG. 5 shows a sectional view of a concave connector according to an embodiment of the invention.
Figure 9:
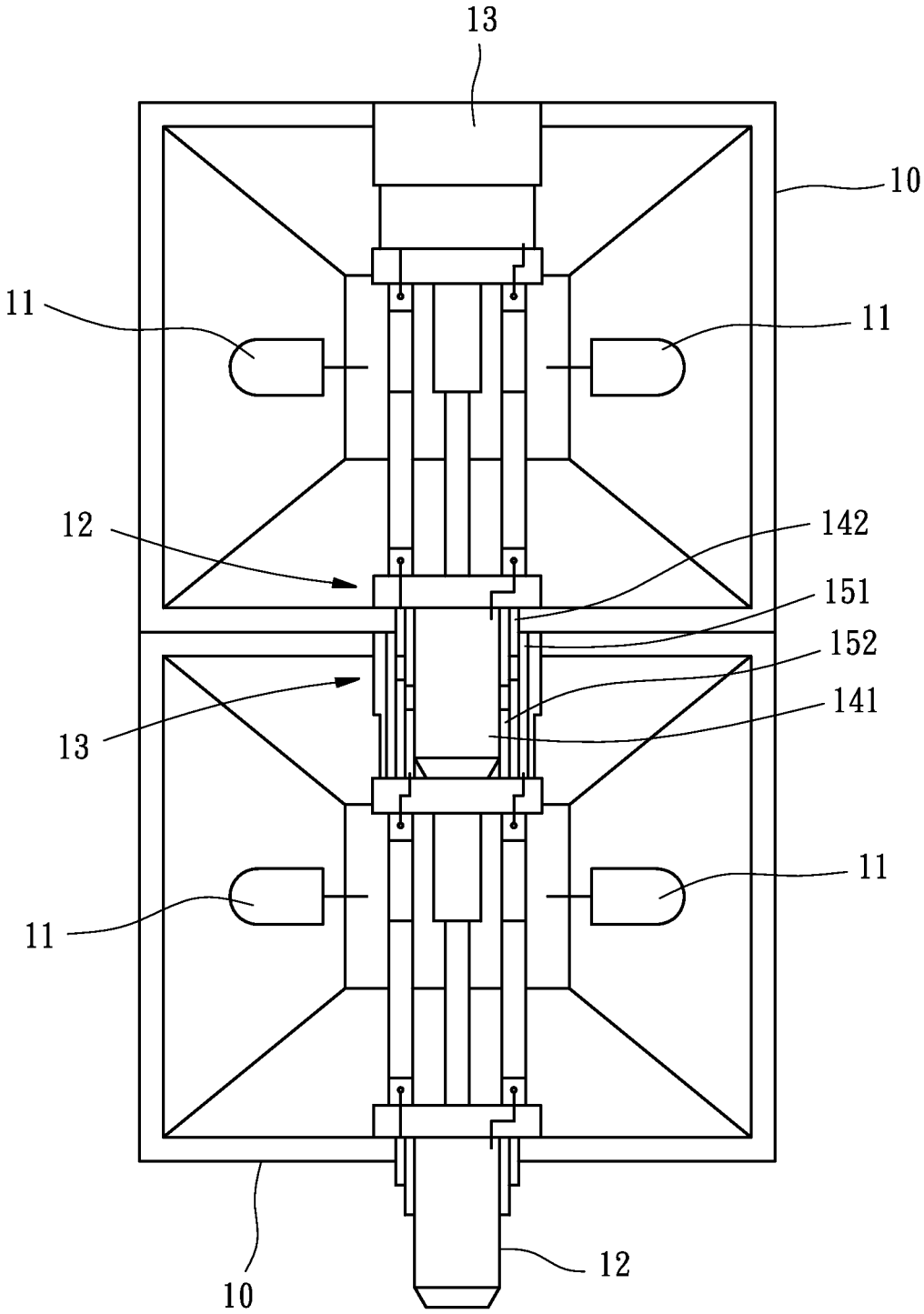
FIG. 9 shows a sectional view of two block bodies in combination.

FIGS. 1 to 12 show lamps according to embodiments of the invention. In an embodiment, the lamp includes a plurality of independent block bodies 10 assembled together. As shown in FIGS. 1 to 3, each block body 10 has at least one convex connector 12 or/and at least one concave connector 13. Furthermore, at least one block body 10 has a luminous body 11. As shown in FIGS. 4 and 5, the convex connector 12 and the concave connector 13 have an electrical connection component 14 and an electrical connection component 15, respectively. The luminous body 11 and the electrical connection components 14 and 15 are connected electrically. As shown in FIG. 9, when a block body 10 and its adjacent block body 10 are assembled together, the convex connector 12 of one of them is plugged into the concave connector 13 of the other, so that the electrical connection components 14 and 15 of the connectors 12 and 13 are connected together physically and electrically.

In the multiple independent block bodies 10, some of them may have a luminous body 11, some may have an electrical connection component 14 or 15, some may have only a convex connector 12 or/and a concave connector 13. As a result, there are diversified ways to assemble a lamp using the multiple independent block bodies 10.

The luminous body can include one or more than one light-emitting diode (LED), and hence is energy efficient and not heavy Other light sources can also be used. Depending on the design requirement, luminous bodies can be included in some block bodies, and the configuration and arrangement of the lamination position(s) can allows for many kinds of characters and styles.

Figure 6:
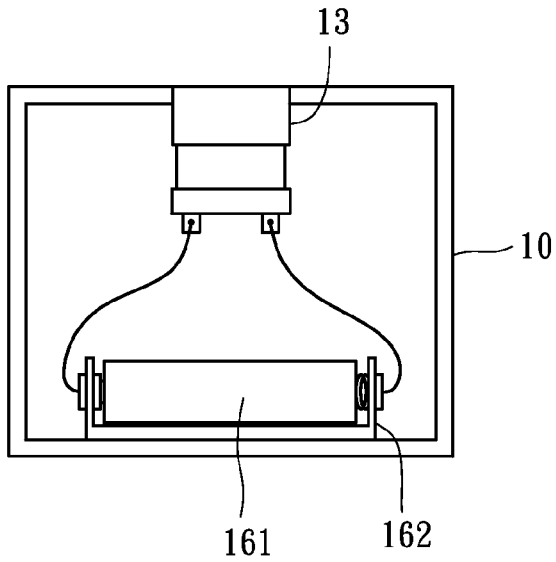
FIG. 6 shows a sectional view of a block body for illustrating the configuration of a battery and a concave connector.
Figure 7:
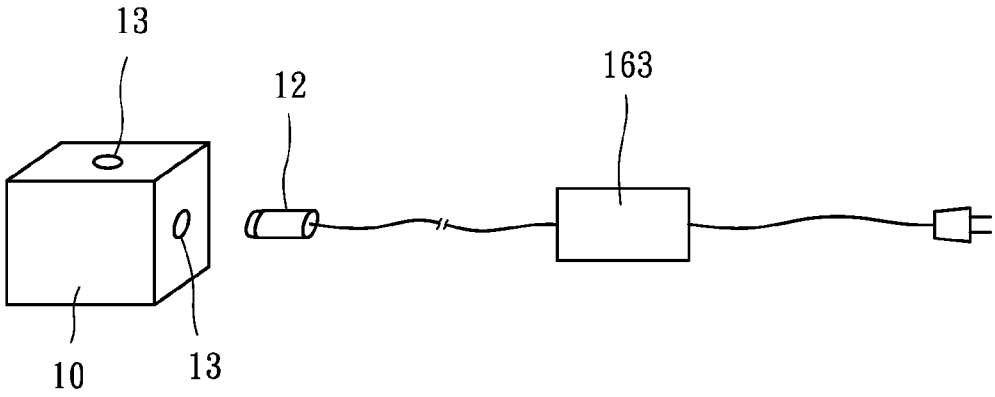
FIG. 7 shows a schematic diagram of a block body and a power supply that are not yet connected.
Figure 8A:
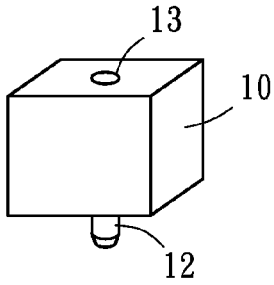
FIGS. 8A~8J show the pictorial views of block bodies of different shapes.
Figure 8B:
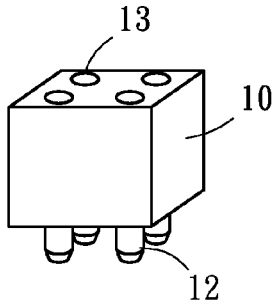
Figure 8C:
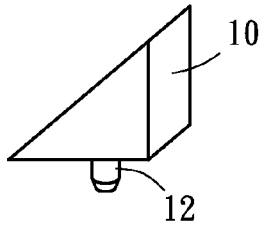
Figure 8D:
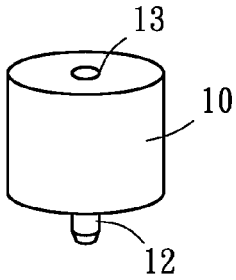
Figure 8E:
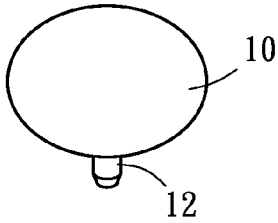
Figure 8F:
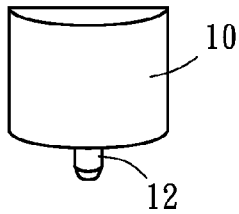
Figure 8G:
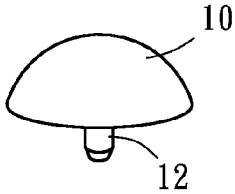
Figure 8H:
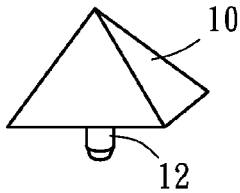
Figure 8I:
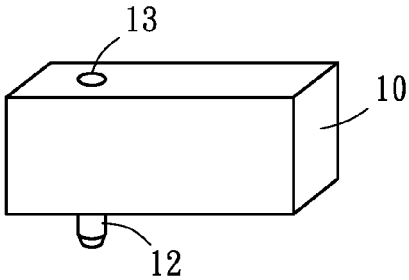
Figure 8J:
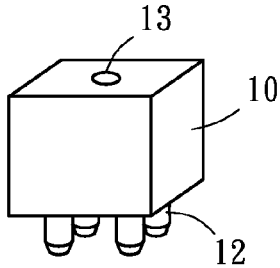

The lamp can further include a power device for supplying electricity required by the lamp. FIGS. 6 and 7 show two alternative ways of embodying the power device.

Please refer to FIG. 6. The power device is installed in at least one block body 10 and includes a battery holder 162 and a battery 161. The block body 10's concave connector 13 (or convex connector) has an electrical connection component that is electrically connected to the battery holder 162.

Please refer to FIG. 7. The power device is a power supply 163. The power supply 163 provides external electricity. The power supply 163 has an aforementioned convex connector 12 (or an aforementioned concave connector) to allow connection with a block body 10 having an electrical connection component in order to supply electricity.

FIGS. 8A to 8J show examples of the block bodies 10. The block bodies 10 can have geometrical configurations. For example, as FIGS. 8A, 8B, 8I, and 8J indicate, a block body 10 can be a cube. As FIG. 8C indicates, a block body 10 can be a triangular prism. As FIG. 8D indicates, a block body 10 can be a cylinder. As FIG. 8E indicates, a block body 10 can be a sphere. As FIG. 8F indicates, a block body 10 can be a semi-cylinder. As FIG. 8G indicates, a block body 10 can be a hemisphere. As FIG. 8H indicates, a block body 10 can be a polygonal pyramid or a polygonal column. Furthermore, some block bodies 10 can have at least some transparent or translucent parts so as to allow light generated by an interior luminous body 11 to come out. For example, a face of a cube can be made up of a transparent or translucent material. Exemplary materials include transparent glass, frosted glass, transparent plastic, or plastic that is not totally transparent. Some other block bodies 10 can be opaque to increase variation and selectivity. But this does not limit the scope of the invention.

In an embodiment, the convex and concave connectors are a set of male plug and female socket. As the sectional view shown in FIG. 4 indicates, the convex connector 12 includes an electrical connection component 14 formed by an inner conduction column 141 and an outer conduction ring 142, an insulation ring 143 between the inner conduction column 141 and the outer conduction ring 142, and a positive terminal 144 and a negative terminal 145 that are connected to the inner conduction column 141 and the outer conduction ring 142, respectively. The inner conduction column 141 extends out from the outer conduction ring 142. As the sectional view shown in FIG. 5 indicates, the concave connector 13 includes an electrical connection component 15 formed by an outer-layer conduction ring 151 and an inner-layer conduction ring 152, an insulation ring 153 between the inner-layer conduction ring 152 and the outer-layer conduction ring 151, and a positive terminal 154 and a negative terminal 155 that are connected to the inner-layer conduction ring 152 and the outer-layer conduction ring 151, respectively. The outer-layer conduction ring 151 extends out from the inner-layer conduction ring 152. Outside the concave connector 13 there is a casing 156 that allows the aforementioned components to be assembled therein. As FIG. 9 indicates, when the convex connector 12 is plugged in the concave connector 13, the inner conduction column 141 contacts the inner-layer conduction ring 152, the outer conduction ring 142 contacts the outer-layer conduction ring 151 to build up electrical connection.

Figure 10:
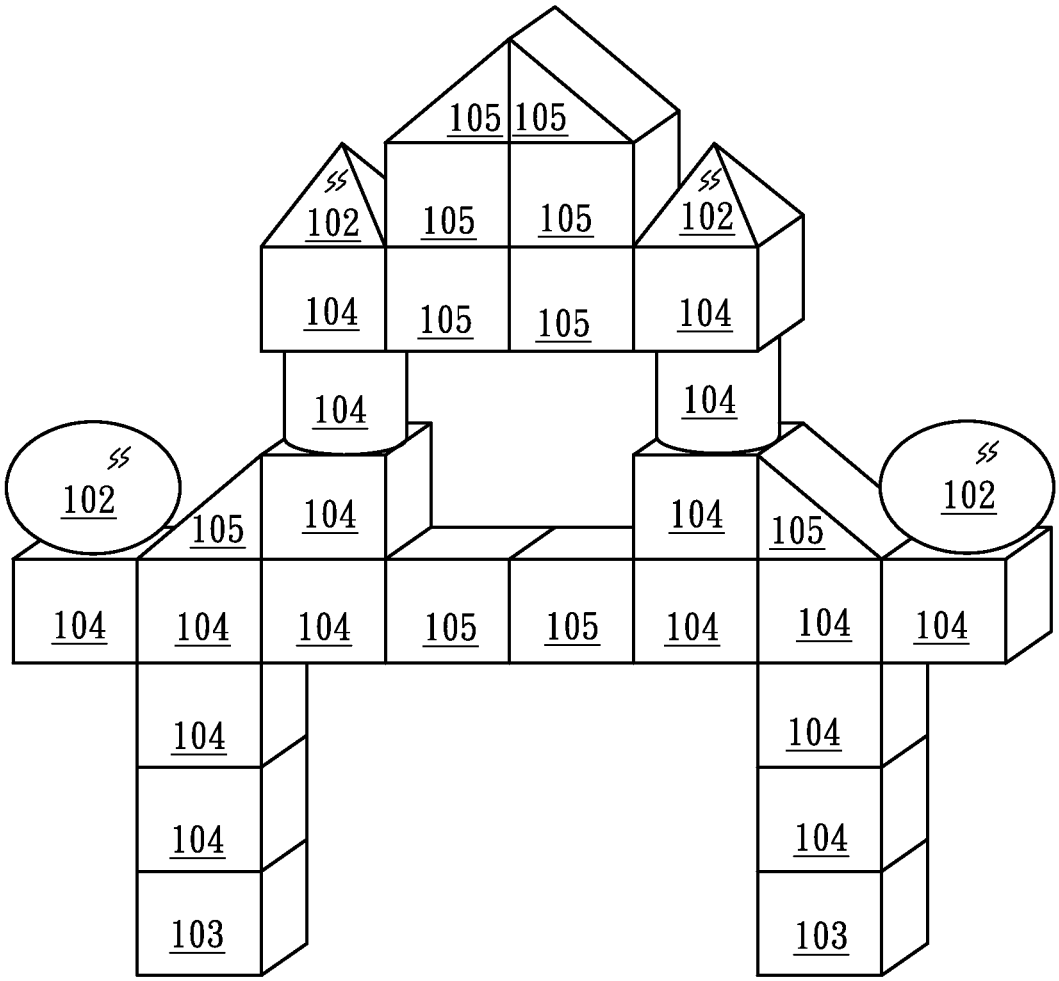
FIGS. 10~12 show assembled lamps with different shapes.
Figure 11:
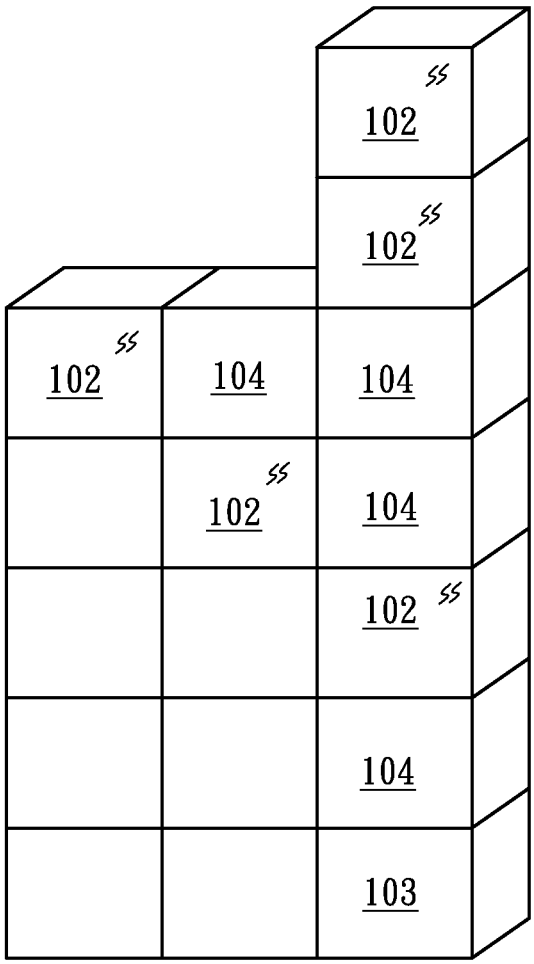
Figure 12:
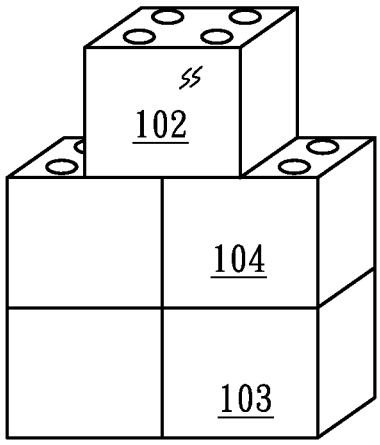

Please refer to FIGS. 10 to 12, they show different assembly configurations of the lamp. As the figures show, block bodies 10 of the same shape (please refer to FIGS. 11 and 12) or/and of different shapes (please refer to FIG. 10) can be assembled together using the convex connectors 12 and the concave connectors 13 therein to form any shape. In practical implementation, at least one block body 102 that has a luminous body 11 is placed where light should come out, and at least one block body 103 is used to supply electricity. The block bodies 104 with electrical connection components are used to electrically connect the block body 103 that supply electricity and the block body 102 that illuminates. Depending on personal preference, other block bodies can either have or be lack of electrical connection components. For example, the block bodies 105 do not have electrical connection components but have only convex and concave connectors.

The lamp has high practical value because it can change shape freely and is interesting, and can encourage creativity.

In the foregoing detailed description, the invention has been described with reference to specific exemplary embodiments thereof. It will be evident that various modifications may be made thereto without departing from the spirit and scope of the invention as set forth in the following claims. The detailed description and drawings are, accordingly, to be regarded in an illustrative sense rather than a restrictive sense.

What is claimed is:

1. A lamp, comprising a plurality of independent block bodies, each comprising at least one convex connector and at least one concave connector, wherein at least one block body has a luminous body, at least a part of the convex connector and the concave connector has an electrical connection component, the electrical connection component and the luminous body are connected electrically, when one block body and an adjacent block body are assembled together, the convex connector of one of two block bodies is plugged into the concave connector of the other of the two block bodies so as to combine the two block bodies tightly, as a result the electrical connection components of the two block bodies are connected physically and electrically, wherein the convex connector comprises the electrical connection component formed by an inner conduction column and an outer conduction ring, an insulation ring between the inner conduction column and the outer conduction ring, and a positive terminal and a negative terminal that are connected to the inner conduction column and the outer conduction ring, respectively, the inner conduction column extends out from the outer conduction ring; the concave connector comprises the electrical connection component formed by an outer-layer conduction ring and an inner-layer conduction ring, an insulation ring between the outer-layer conduction ring and the inner-layer conduction ring, and a positive terminal and a negative terminal that are connected to the inner-layer conduction ring and the outer-layer conduction ring, respectively, the outer-layer conduction ring extends out from the inner-layer conduction ring.

2. The lamp of claim 1, wherein the convex and concave connectors are a set of male plug and female socket.

3. The lamp of claim 1, wherein the block body has a geometrical configuration.

4. The lamp of claim 3, wherein the block body is selected from a group consisting of cube, triangular prism, cylinder, sphere, semi-cylinder, hemisphere, polygonal pyramid, and polygonal column.

5. The lamp of claim 1, further comprising a power device for providing power to the lamp.

6. The lamp of claim 5, wherein the power device is installed within the at least one block body, the power device comprises a battery holder and a battery, and the electrical connection component is electrically connected to the battery holder.

7. The lamp of claim 5, wherein the power device is a power supply, the power supply provides external electricity, and the power supply can be plugged into any block body that has the electrical connection component.

8. The lamp of claim 3, wherein at least a part of the block body is transparent or translucent.

9. The lamp of claim 1, wherein the luminous body is a light-emitting diode (LED).

10. The lamp of claim 1, wherein the plurality of independent block bodies comprise block bodies with electrical connection components.

11. An assembly structure of a lamp, comprising a block body, wherein the block body comprises at least one convex connector and at least one concave connector, and each of the convex connector and the concave connector comprises an electrical connection component, wherein the convex connector comprises an electrical connection component formed by an inner conduction column and an outer conduction ring, an insulation ring between the inner conduction column and the outer conduction ring, and a positive terminal and a negative terminal that are connected to the inner conduction column and the outer conduction ring, respectively, the inner conduction column extends out from the outer conduction ring; the concave connector comprises an electrical connection component formed by an outer-layer conduction ring and an inner-layer conduction ring, an insulation ring between the outer-layer conduction ring and the inner-layer conduction ring, and a positive terminal and a negative terminal that are connected to the inner-layer conduction ring and the outer-layer conduction ring, respectively, the outer-layer conduction ring extends out from the inner-layer conduction ring.

12. The assembly structure of claim 11, wherein the block body comprises a luminous body, and the luminous body and the electrical connection component are connected electrically.

13. The assembly structure of claim 11, wherein the convex connector and the concave connector correspond to each other, and when two block bodies are assembled together, the convex connector and the concave connector of the two block bodies combine with each other tightly, as a result the electrical connection components of the convex connector and the concave connector are connected physically and electrically.

* * * * *